US007660190B2

(12) United States Patent
Keskes et al.

(10) Patent No.: US 7,660,190 B2
(45) Date of Patent: Feb. 9, 2010

(54) DEFLECTOR DEVICES

(75) Inventors: Emmanuel Keskes, Nantes (FR); Philippe Saint-Pere, Vanves (FR)

(73) Assignee: WesternGeco L.L.C., Houston, TX (US)

( * ) Notice: Subject to any disclaimer, the term of this patent is extended or adjusted under 35 U.S.C. 154(b) by 1246 days.

(21) Appl. No.: 10/450,862

(22) PCT Filed: Dec. 12, 2001 (Under 37 CFR 1.47)

(86) PCT No.: PCT/IB01/02499

§ 371 (c)(1), (2), (4) Date: Sep. 12, 2006

(87) PCT Pub. No.: WO02/47968

PCT Pub. Date: Jun. 20, 2002

(65) Prior Publication Data

US 2008/0205192 A1 Aug. 28, 2008

(30) Foreign Application Priority Data

Dec. 16, 2000 (GB) ..... 0030743.9

(51) Int. Cl.
*G01V 1/38* (2006.01)

(52) U.S. Cl. ..... 367/16; 367/17; 114/244

(58) Field of Classification Search ..... 367/16, 367/17, 18; 114/242, 244, 246
See application file for complete search history.

(56) References Cited

U.S. PATENT DOCUMENTS 3,372,666 A * 3/1968 Baker ..... 114/245
3,531,761 A * 9/1970 Clift, Jr. et al. ..... 367/17
3,611,975 A * 10/1971 Ashbrook ..... 114/245
3,613,629 A * 10/1971 Rhyne et al. ..... 114/245
3,618,555 A * 11/1971 Kelly et al. ..... 114/244
4,033,278 A * 7/1977 Waters ..... 114/245
4,055,138 A * 10/1977 Klein ..... 114/244
4,484,534 A * 11/1984 Thillaye du Boullay ..... 114/244
4,676,183 A * 6/1987 Conboy ..... 114/245

(Continued)

FOREIGN PATENT DOCUMENTS

EP 0 562 780 9/1993
GB 2 332 660 6/1999

OTHER PUBLICATIONS

UK Search Report dated Feb. 26, 2001, for Application No. GB 0030743.9.

*Primary Examiner*—Scott A Hughes
(74) *Attorney, Agent, or Firm*—Jeff Pyle; Richard Wells; Kevin McEnaney

(57) ABSTRACT

A deflector device (22) for use with a tow line between a seismic survey vessel and a tow, in particular a seismic streamer or streamer array, in the water behind the vessel comprises a vertically oriented wing-shaped body (28) shaped to produce in use a sideways force which urges the tow line laterally with respect to the direction of movement of the towing vessel. The wing-shaped body (28) includes one or more buoyancy elements, and a rearwardly extending boom (32). A pivotable control surface (54) extends sideways from the boom (32), and is shaped to produce in use a force having a substantial vertical component. The angle of the control surface is remotely controllable, in order to control the depth of the deflector device.

13 Claims, 3 Drawing Sheets

U.S. PATENT DOCUMENTS

| | | | | |
|---|---|---|---|---|
| 4,729,333 | A * | 3/1988 | Kirby et al. | 114/244 |
| 5,357,892 | A * | 10/1994 | Vatne et al. | 114/244 |
| 5,532,975 | A * | 7/1996 | Elholm | 367/16 |
| 6,234,102 | B1 * | 5/2001 | Russell et al. | 114/253 |
| 6,532,189 | B2 * | 3/2003 | Barker | 367/17 |
| 6,877,453 | B2 * | 4/2005 | Hocquet et al. | 114/244 |
| 6,879,542 | B2 * | 4/2005 | Soreau et al. | 367/17 |
| 7,156,035 | B2 * | 1/2007 | Hocquet et al. | 114/244 |
| 2004/0065244 | A1 * | 4/2004 | Hocquet et al. | 114/244 |

* cited by examiner

DEFLECTOR DEVICES

This invention relates to deflector devices of the kind used between a towing vessel and a tow located in water, for example a seismic streamer or streamer array, or a seismic source array, in order to pull the tow out to one side of the vessel, so as to position it at a desired lateral offset from the course followed by the vessel.

A deflector device of this kind is described in detail in our U.S. Pat. No. 5,357,892, and comprises a wing-shaped deflector body having a remotely-operable pivotal lever or "boom" which extends rearwardly from a point near the middle of the trailing edge of the wing-shaped body. In use, the wing-shaped body is suspended beneath a float so as to be completely submerged and positioned generally vertically in the water, and is connected to the towing vessel by means of a tow line, while the tow is connected to the end of the boom remote from the wing-shaped body. As the device is pulled through the water, the wing-shaped body produces a sideways force, or "lift", which moves the tow laterally. This lift can be varied by adjusting the angle of the boom from the vessel, thus permitting the lateral offset of the tow from the course of the vessel to be varied in use.

The deflector device of U.S. Pat. No. 5,357,892 has been successfully commercialised by the Applicant as its MONOWING deflector device. In use, rolling stability of the device is provided by the connection to the float, while stability of the device about a vertical axis is provided by the drag produced by the tow.

The MONOWING deflector devices in current use are very large, typically 7.5 m high by 2.5 m wide, and weigh several tonnes. They are usually suspended around 2 m to 8 m below the float by means such as a fibre rope, and are also provided with a safety chain intended to prevent separation of the float and wing-shaped body in the event that the rope breaks. In rough weather, the upper part of the wing-shaped body may rise up out of the water, allowing the rope connecting the wing-shaped body and the float to go slack. If the wing-shaped body then drops abruptly, the rope, and possibly even the safety chain, may break, and/or their attachment points on the wing-shaped body may be badly damaged.

Additionally, the depth at which the current deflector device operates is effectively determined by the length of the rope connecting it to the float. As a result of this, the operating depth of the deflector device cannot readily be varied while the device is deployed in the water. And since the normal operating depth of the current deflector device is typically a few meters, in the event of the onset of bad weather during a survey, the device and all the streamers and other equipment directly or indirectly attached to it have to be recovered onto the towing vessel, and then re-deployed when the bad weather has passed, both of which operations are very time consuming.

It is an object of the present invention to alleviate the drawbacks arising from the connection of the deflector device to the float.

According to the present invention, there is provided a deflector device for use with a tow line between a towing vessel and a tow in water behind the vessel, the device comprising a wing-shaped body shaped to produce in use a sideways force which urges the tow line laterally with respect to the direction of movement of the towing vessel, one or more buoyancy elements disposed within and/or secured to the upper end of the wing-shaped body, a boom extending rearwardly from the wing-shaped body, and a remotely-operable pivotable control surface extending sideways from the boom and shaped to produce in use a force having a vertical component, whereby to control the depth of the deflector device.

It will be appreciated that since the deflector device of the invention can generate a controllable vertical force, this force, together with the buoyancy of the one or more buoyancy elements, can be selected and adjusted so that the separate surface float is no longer required, and the operating depth of the device can be remotely controlled while the device is deployed in the water. In particular, at the onset of bad weather, the deflector device and its tow can be caused to dive to a greater depth, where the effects of the bad weather are much reduced, until the weather improves.

Advantageously, the one or more buoyancy elements has or have a buoyancy selected to give the complete device a small positive buoyancy.

In a preferred embodiment of the invention, the deflector device further comprises an auxiliary wing-shaped body, smaller than the first mentioned (or principal) wing-shaped body, secured to the end of the boom remote from the principal wing-shaped body and shaped so as to produce in use a sideways force in generally the opposite direction to that produced by the principal wing-shaped body. Advantageously, this embodiment further includes remotely-operable means for varying the angle of the auxiliary wing-shaped body to vary the sideways force produced by the auxiliary wing-shaped body, and thereby vary the sideways force produced by the principal wing-shaped body.

The pivotable control surface and the remotely-operable means are preferably both hydraulically operated.

Advantageously, the auxiliary wing-shaped body is provided with a trailing edge flap angled away from the boom, typically at about 35°.

The invention also includes a method of performing a marine seismic survey, the method including towing a plurality of laterally spaced seismic steamers over an area to be surveyed, wherein the lateral position and the depth of at least one of the streamers are controlled by a deflector device in accordance with any one of the preceding statements of invention.

The invention will now be described by way of example only, with reference to the accompanying drawings, of which:

Figure 1:
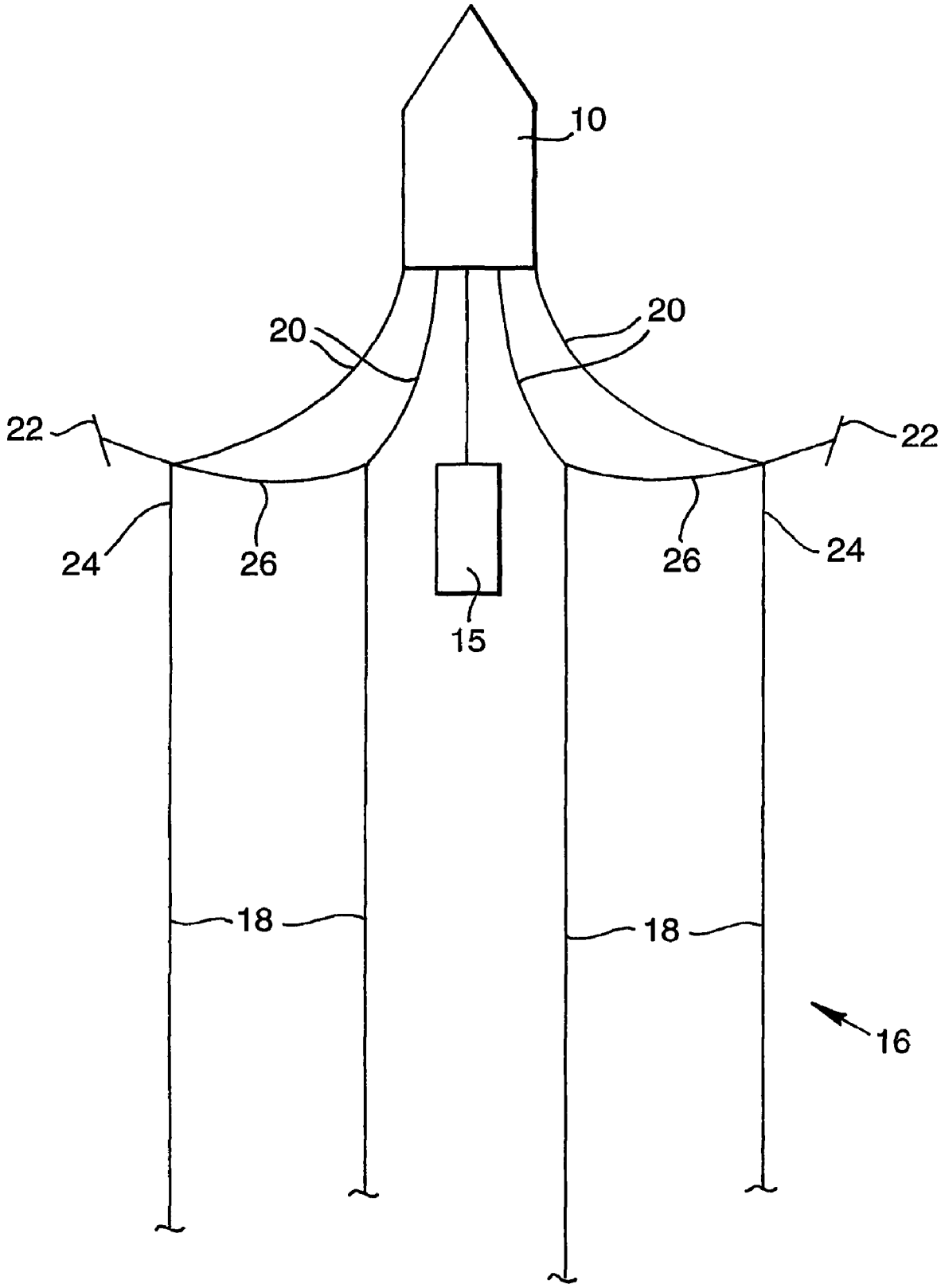
FIG. 1 is a somewhat schematic view of a seismic survey vessel carrying out a marine seismic survey.

The seismic survey vessel shown in FIG. 1 is indicated generally at 10, and is preferably as described in our PCT Patent Application No. PCT/GB98/01832 (WO 99/00295). The vessel 10 is shown towing a seismic source 15, typically a TRISOR multiple air gun source of the kind described in our U.S. Pat. No. 4,757,482, and an array 16 of four substantially identical streamers 18. However, it will be appreciated that, in practice, many more than four streamers can be towed, for example by using the techniques described in our PCT Patent Application No. PCT/IB98/01435 (WO 99/15913). The streamers 18 are towed by means of their respective lead-ins 20 (ie the high strength steel- or fibre-reinforced electrical or electro-optical cables which convey electrical power, control and data signals between the vessel 10 and the streamers), and their spread is controlled by two deflector devices, indicated at 22, connected to the respective forward ends 24 of the two outermost streamers. The deflector devices 22 act in co-operation with respective spreader lines 26 connected between the forward end 24 of each outermost streamer 18 and the forward end 24 of its adjacent streamer to maintain a substantially uniform spacing between the streamers.

Figure 2:
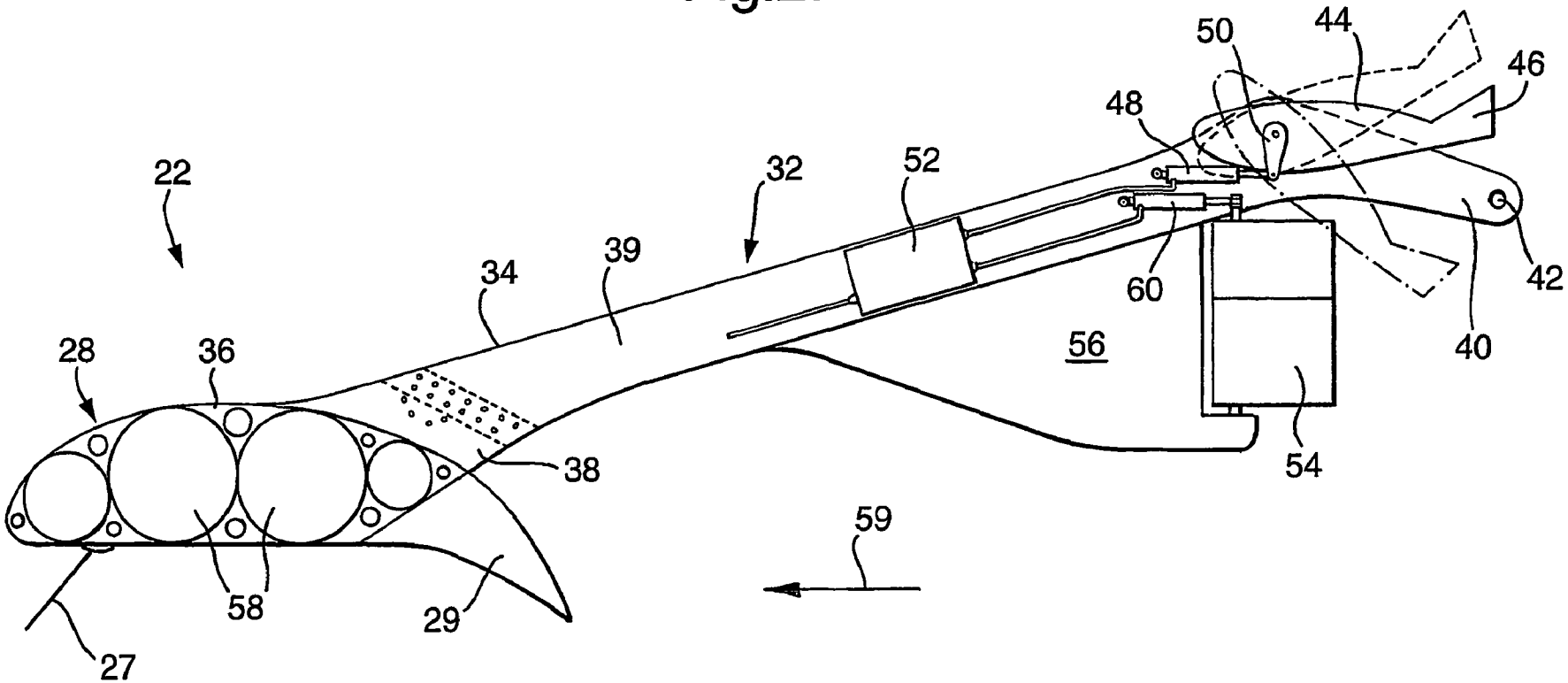
FIG. 2 is a somewhat schematic part-sectional view of a first embodiment of a deflector device in accordance with the present invention, for use in carrying out the survey of FIG. 1.
Figure 3A:
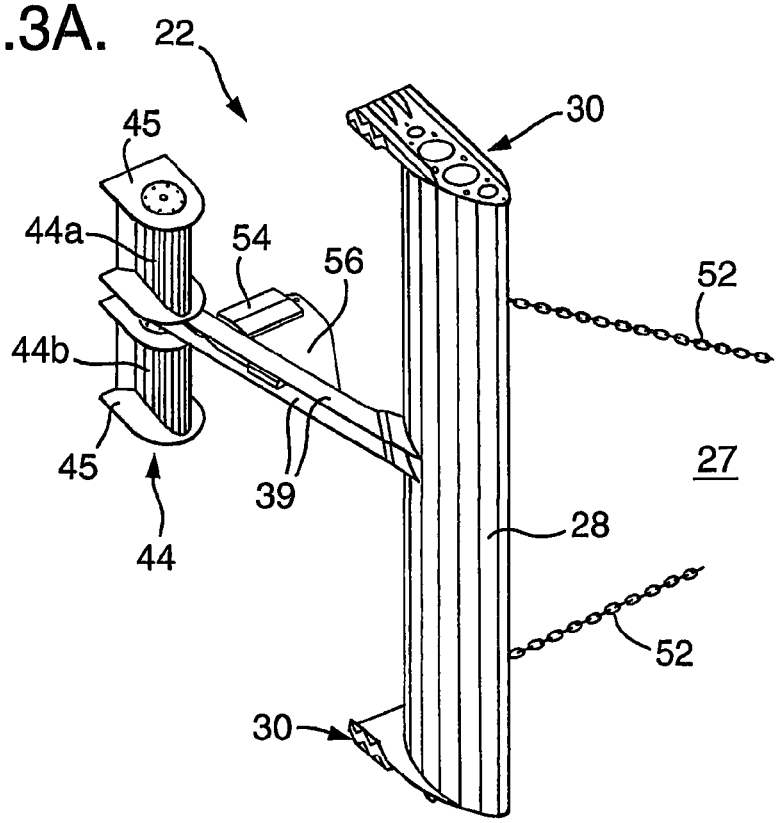
FIGS. 3A and 3B are respective perspective view of the deflector device of FIG. 2.
Figure 3B:
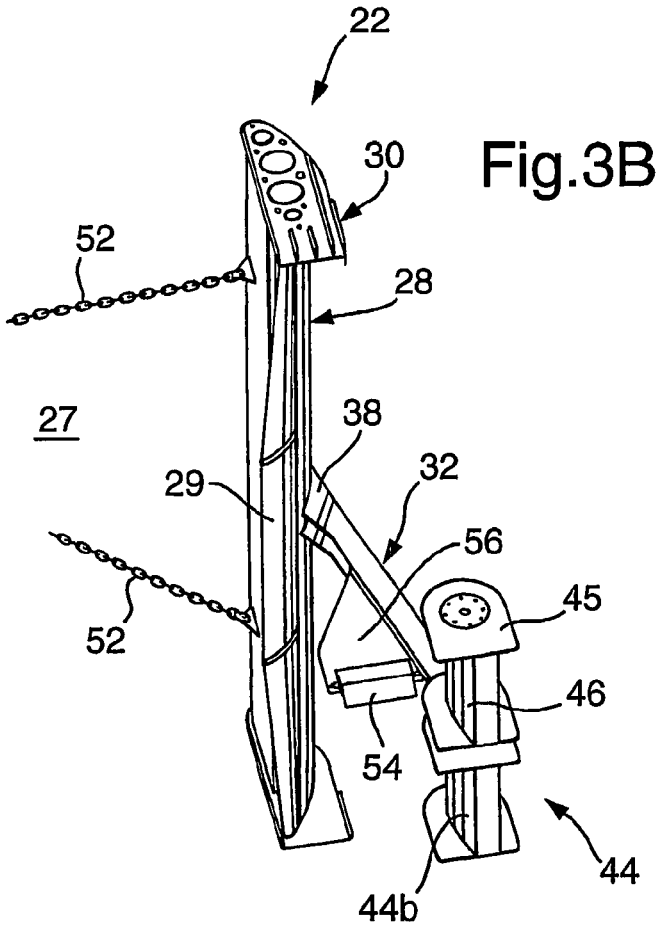

One of the deflector devices 22 is shown in more detail in FIGS. 2, 3A and 3B. The deflector device 22 is similar in general principle to the deflector device of our U.S. Pat. No. 5,357,892, but is a much improved version of it. In particular, the deflector device 22 has a main wing-shaped body 28 which is coupled in use to a respective outer lead-in 20 via a towing bridle 27, and which corresponds to the deflector body 2 of U.S. Pat. No. 5,357,892. However, the main wing-shaped body 28 is of improved hydrodynamic cross-sectional shape and includes a fixed-angle trailing edge flap 29, both of which features enhance lift. Also, the main wing-shaped body 28 is provided with vortex controlling end plates 30 (see FIGS. 3A and 3B) of the kind described in our PCT Patent Application No. PCT/FR99/02272, to reduce drag and improve stability, and is largely made of titanium to reduce weight, while the towing bridle 27 comprises a pair of titanium chains 52 (see FIGS. 3A and 3B).

Additionally, the angle lever 10 of U.S. Pat. No. 5,357,892 is replaced by a rearwardly extending fixed angle boom 32, which is detachably connected at one end 34 to the low pressure side 36 of the body 28 near the trailing edge flap 29, at a mounting bracket 38. The boom 32 is of sandwich construction, and is made from two similarly shaped plates 39 which are bolted together at intervals along their length and which sandwich between them the mounting bracket 38. Typically, the boom 32 is detached from the bracket 38 whenever the deflector device 22 is on the vessel 10, for ease of stowage. The other end 40 of the boom 32 has a towing eye 42, coupled in use to the forward end 24 of a respective one of the two outermost streamers 18.

An auxiliary wing-shaped body 44, which is much smaller than the body 28 in length, thickness and chord, is pivotally secured as will be explained hereinafter to the end 40 of the boom 32, with its longitudinal axis (which lies in a plane perpendicular to the plane of FIG. 2) extending parallel to the longitudinal axis of the body 28. The shape of the body 44 is designed to produce, in use, a sideways force in a direction approximately opposite to that produced by the body 28 (approximately opposite, because as will become apparent, the direction of the force varies in use). This sideways force is increased by providing the body 44 with a fixed trailing edge flap 46, angled away from the boom 32 at an angle of about 35°.

As best seen in FIGS. 3A and 3B, the auxiliary wing-shaped body 44 is implemented in two symmetrical halves 44*a* and 44*b*, which each have vortex-reducing end plates 45 and which are disposed on opposite sides of the boom 32. These two halves 44*a*, 44*b* are rotatable in unison about a common axis perpendicular to the plane of the boom 32, so as to vary the angle of the chord of the auxiliary wing-shaped body 44 with respect to the boom. Rotation of the auxiliary wing-shaped body 44 is effected by a telescopic actuator 48 pivotally mounted between the plates 39 of the boom 32, the actuator being pivotally connected to a lever arm or eccentric 50 secured to each of the two halves 44*a*, 44*b* of the auxiliary wing-shaped body. The telescopic actuator 48 is hydraulically operated by a remotely controllable electro-hydraulic control pack 52 also mounted between the plates 39 of the boom 32.

It will be appreciated that varying the angle of the auxiliary wing-shaped body 44 of the deflector device 22 changes the angle of the main wing-shaped body 28 with respect to the direction of tow, and so changes the lift produced by the main wing-shaped body. This in turn changes the lateral offset produced by the deflector device 22.

In accordance with the present invention, the deflector device 22 is made approximately neutrally buoyant, by including gas-filled pipe-like buoyancy elements 58 extending longitudinally within it from top to bottom, and/or by providing an integral buoyancy element at its upper end similar to but smaller than that described in our co-pending United Kingdom Patent Applications Nos. 0023775.0, 0025719.6 and 0029451.2. In practice, the deflector device 22 is preferably designed to be slightly positively buoyant, so that in the event of a malfunction, it tends to float rather than to sink.

Additionally, the deflector device 22 is provided with a pivotable control surface (or flap) 54, which is secured to the boom 32 in the region of the auxiliary wing-shaped body 44 by a generally triangular bracket 56, and which is pivotable about an axis perpendicular to both the pivot axis of the body 44 and the direction of tow (indicated by the arrow 58 in FIG. 2). The flap 54 and the bracket 56 are both made from titanium. The angular position of the flap 54 is controlled by a further telescopic actuator 60, which is connected to a lever arm 62 provided on the flap, and which is hydraulically operated by the electro-hydraulic control pack 52. It will be appreciated that rotation of the flap 54 about its pivot axis produces in use an upward or downward force at the end 40 of the boom 32, and thus enables the depth of the deflector device 22 to be controlled.

It will be appreciated that as a result of making the deflector device 22 approximately neutrally buoyant and capable of generating a remotely-controllable vertical force, a separate surface float is no longer required, and the operating depth of the device can be remotely controlled while the device is deployed in the water. In particular, in the event of the onset of bad weather, the deflector device 22 and the streamers 18 attached to it can be caused to dive to a greater depth, where the effects of the bad weather are much reduced, until the bad weather passes.

Many modifications can be made to the described embodiment of the invention.

In particular, the flap 54 and the auxiliary wing-shaped body 44 can be made from a plastics material reinforced with high strength fibres, eg Kevlar fibres, and can be electrically actuated rather than hydraulically actuated, Additionally, the devices 22 and 60 can be used with tows other than streamers, for example seismic sources, and the tow need not be connected to the end 40 of the boom 32 (it could instead be connected to the lead-in 20, at a point near where the bridle 24 is connected to the lead-in). Also, the invention can if desired be used with a deflector device in which the auxiliary wing-shaped body 44 is fixed, and the boom 32 is pivotable towards and away from the main deflector body 28, as described in our United Kingdom Patent Applications Nos. 0023755.2, 0025711.3 and 0029452.0. Indeed, the invention can even be used with a deflector device like that described in our U.S. Pat. No. 5,357,892, ie a deflector device without the auxiliary wing-shaped body 44, by mounting a pivotable flap analogous to the flap 54 on a pivotable boom analogous to the angle lever 10 of the deflector device of the US patent.

Finally, although the invention has been described in relation to deflector devices whose lift can be varied by varying the angle of the device with respect to the direction of tow, it is also applicable in its broadest aspect to a fixed angle deflector device, eg of the kind referred to as a "door".

The invention claimed is:

1. A deflector device for use with a tow line between a towing vessel and a tow in water behind the vessel, the device comprising:

a principal wing-shaped body shaped to produce in use a sideways force which urges the tow line laterally with respect to the direction of movement of the towing vessel;

one or more buoyancy elements disposed within and/or secured to the upper end of the principal wing-shaped body;

a boom extending rearwardly from the principal wing-shaped body;

a pivotable control surface extending sideways from the boom and shaped to produce in use a force having a substantial vertical component; and remotely-operable means for pivoting the control surface, thereby to control the depth of the deflector device substantially independently of the lateral position of the deflector device.

2. A deflector device as claimed in claim 1, wherein the one or more buoyancy elements have a buoyancy selected to give the complete device a small positive buoyancy.

3. A deflector device as claimed in claim 1, wherein the remotely-operable means comprises a telescopic member connected to pivot the control surface.

4. A deflector device as claimed in claim 3, wherein the telescopic member is hydraulically operated.

5. A deflector device as claimed in claim 1, further comprising an auxiliary wing-shaped body, smaller than the principal wing-shaped body, secured to the end of the boom remote from the principal wing-shaped body and shaped so as to produce in use a sideways force in generally the opposite direction to that produced by the principal wing-shaped body.

6. A deflector device as claimed in claim 5, further comprising additional remotely-operable means for varying the angle of the auxiliary wing-shaped body to vary the sideways force produced by the auxiliary wing-shaped body, and thereby vary the sideways force produced by the principal wing-shaped body.

7. A deflector device as claimed in claim 6, wherein the additional remotely-operable adjusting means comprises a further telescopic member connected to the auxiliary wing-shaped body.

8. A deflector device as claimed in claim 7, wherein the further telescopic member is hydraulically operated.

9. A deflector device as claimed in claim 5, wherein the auxiliary wing-shaped body is provided with a trailing edge flap angled away from the boom.

10. A method of performing a marine seismic survey, comprising:

towing a plurality of laterally-spaced seismic streamers over an area to be surveyed, wherein the lateral position and the depth of at least one of the streamers are controlled by a deflector device comprising:

a principal wing-shaped body shaped to produce in use a sideways force which urges the tow line laterally with respect to the direction of movement of the towing vessel;

one or more buoyancy elements disposed within and/or secured to the upper end of the principal wing-shaped body;

a boom extending rearwardly from the principal wing-shaped body;

a pivotable control surface extending sideways from the boom and shaped to produce in use a force having a substantial vertical component; and remotely-operable means for pivoting the control surface, thereby to control the depth of the deflector device substantially independently of the lateral position of the deflector device.

11. The method of claim 10, further comprising selecting a buoyancy of the one or more buoyancy elements to give the complete device a small positive buoyancy.

12. The method of claim 10, wherein the remotely-operable means comprises a telescopic member connected to the control surface, and further comprising pivoting the control surface using the telescopic member.

13. The method of claim 10, wherein the deflector device includes an auxiliary wing-shaped body, smaller than the principal wing-shaped body, secured to the end of the boom remote from the principal wing-shaped body and shaped so as to produce in use a sideways force in generally the opposite direction to that produced by the principal wing-shaped body, and further comprising varying the angle of the auxiliary wing-shaped body to vary the sideways force produced by the auxiliary wing-shaped body, and thereby vary the sideways force produced by the principal wing-shaped body.

* * * * *